US006530103B2

(12) United States Patent
Pan et al.

(10) Patent No.: US 6,530,103 B2
(45) Date of Patent: Mar. 11, 2003

(54) METHOD AND APPARATUS FOR ELIMINATING WAFER BREAKAGE DURING WAFER TRANSFER BY A VACUUM PAD

(75) Inventors: Jeng-Yang Pan, Hsinhu (TW); Chia-Chun Wu, Hsin-Chu (TW); Wen-Fang Tang, Hsinchu (TW); Su-Yu Yeh, Taipei (TW); Huai-Tei Yang, Hsin-Chu (TW)

(73) Assignee: Taiwan Semiconductor Manufacturing Company, Ltd., Hsin Chu (TW)

( * ) Notice: Subject to any disclaimer, the term of this patent is extended or adjusted under 35 U.S.C. 154(b) by 0 days.

(21) Appl. No.: 09/886,810

(22) Filed: Jun. 21, 2001

(65) Prior Publication Data

US 2002/0194689 A1 Dec. 26, 2002

(51) Int. Cl.[7] ..... B08B 11/02
(52) U.S. Cl. ..... 15/77; 15/102; 279/3
(58) Field of Search ..... 279/3; 15/77, 88.2, 15/88.3, 102

(56) References Cited

U.S. PATENT DOCUMENTS 4,457,661 A * 7/1984 Flint et al.
4,476,601 A * 10/1984 Oka
5,682,638 A * 11/1997 Kaiser
5,894,622 A * 4/1999 Manfredi et al.

FOREIGN PATENT DOCUMENTS

EP 0764478 A1 * 3/1997
EP 0893819 A2 * 1/1999

* cited by examiner

*Primary Examiner*—Terrence R. Till
(74) *Attorney, Agent, or Firm*—Tung & Associates

(57) ABSTRACT

A method for eliminating wafer breakage during a wafer transfer process in a grinding apparatus by a wafer transfer pad and an apparatus for conducting such method are disclosed. In the method, a surface of the vacuum pad, or the wafer transfer pad, that is formed of sintered ceramic is first cleaned by contacting a rotating brush and a spray of cleaning solvent. The invention further discloses an apparatus for eliminating wafer breakage during the wafer transfer process by a vacuum pad by incorporating a pressure regulating valve situated in the vacuum conduit such that a vacuum pressure applied can be regulated at a rate not higher than 30 psi/sec. to the surface of the wafer transfer pad.

8 Claims, 5 Drawing Sheets

METHOD AND APPARATUS FOR ELIMINATING WAFER BREAKAGE DURING WAFER TRANSFER BY A VACUUM PAD

FIELD OF THE INVENTION

The present invention generally relates to a method and an apparatus for transferring wafers in a process machine by using a vacuum pad and more particularly, relates to a method and apparatus for eliminating wafer breakage problem during wafer transfer by a vacuum pad in a process machine by cleaning the pad with a rotating brush or by applying vacuum pressure to the pad at a slow rate.

BACKGROUND OF THE INVENTION

In semiconductor processing, the process of backside grinding, or backlapping process, is frequently used in reducing the thickness of a wafer and in correcting any curvature in the wafer to achieve planarity and parallelism of the top and bottom surfaces of a wafer. Since a wafer polishing process can only remove a maximum thickness of about 5 $\mu$m, the polishing process cannot be used effectively to thin down a wafer or to correct the curvature of a wafer and achieve parallelism of the surfaces. Furthermore, the backside grinding or the backlapping process is frequently used before a wafer polishing process to achieve major thickness reductions. The wafer backside grinding process can be carried out in a lapping apparatus which may be a single-side lapping or a double-side lapping.

In a commercial backside grinding apparatus, such as one made by the Disco Company of Japan, a wafer transfer arm or a robotic arm is used for transferring wafers from one polishing station to another polishing station. For instance, in a backside grinding apparatus, there are usually at least three separate stations of a course grinding station, a fine grinding station and a cleaning/spin dry station.

As shown in FIG. 1, a T-shaped arm 12 is used in a backside grinding apparatus chamber 10 for transferring wafers from station to station. The T-shaped transfer arm 12 is constructed by a robotic arm 14 equipped with three vacuum conduits 16,18 and 20. At the end of each of the vacuum conduits 16~20, is provided with a wafer transfer pad 22. The wafer transfer pad is fabricated of a sintered ceramic material that has a multiplicity of vacuum passageways therethrough. The wafer transfer pads 22 are shaped in the shape of a flat disk that has a diameter of approximately 4" when used to transfer 6" wafers. As shown in FIG. 1, wafers 24 are positioned at the center of chuck tables 26 for processing at various polishing stations. The sintered ceramic material may be formed of glass powders that are fused together at a high sintering temperature forming a sponge-like structure and thereby providing a multiplicity of vacuum passageways therethrough.

The wafer transfer pad 22 functions when the T-shaped arm 12 turns at an angle, as shown in FIG. 2, such that the wafer transfer pads 22 are positioned directly on top of the wafers 24. After a vacuum is withdrawn from the conduits 18,20, the wafer 24 is picked-up by the wafer transfer pads 22. After the wafers 24 are picked-up by the wafer transfer pads 22, the T-shaped arm 12 turns to a predetermined angle such that wafers 24 can be either unloaded from the backside grinding apparatus 10 or transferred to the next process station by positioning the wafer 24 onto a chuck table 26.

During the operation of the backside grinding apparatus, various grinding debris and by-products in the form of particles are generated. In order to avoid contamination by the debris or particles to the wafer surface, the wafer transfer pads 22 must be frequently cleaned in order to remove any particle that is left on the surface of the pad 22.

A typical wafer transfer pad cleaning process and apparatus are shown in FIG. 3. The cleaning apparatus 30 consists of a solenoid valve 32 for the vacuum source, a vacuum sensor 34, a solenoid valve 36 for the water and air mixed flow, flow meters 38,40 for air and water, respectively, and a wafer transfer pad 22. A water/air mixture is fed through the backside of the wafer transfer pad 22 by conduit 42. The water/air mixture purges through a thickness of the wafer transfer pad 22 to flush out all contaminating particles and backside grinding debris.

During a normal wafer transfer process, vacuum pressure is applied through the wafer transfer pad 22 for picking-up a wafer. A profile of the vacuum pressure vs. time is shown in FIG. 4 for a conventional vacuum system. It is seen that within a period of time of 1 sec., the vacuum pressure applied increases from about 15 psi to about 75 psi. The rate of pressure increase is therefore about 60 psi/sec.

Problems are frequently caused by either the conventional pad cleaning process shown in FIG. 3, or by the conventional vacuum pressure system shown in FIG. 4. For instance, the conventional pad cleaning method of FIG. 3 is not always effective in removing all backside grinding debris and contaminating by-product particles. Any residual particles left on the surface of the wafer transfer pad 22 creates a pressure point when the particle is caught in-between the wafer transfer pad and a wafer. Such pressure point, or stress concentration point, can cause wafer breakage. The conventional vacuum pressure system of FIG. 4 may further cause problems in that the sudden increase in the vacuum pressure, i.e. at a rate of about 60 psi per sec., may impact the wafer and cause the wafer to break or fracture.

It is therefore an object of the present invention to provide a wafer transfer pad cleaning method that does not have the drawbacks or shortcomings of the conventional pad cleaning process.

It is another object of the present invention to provide a wafer transfer pad cleaning method in which all contaminating particles can be removed from the surface of the wafer transfer pad.

It is a further object of the present invention to provide a wafer transfer pad cleaning method by utilizing a rotating brush on the surface of the pad simultaneously with the spray of a cleaning solvent.

It is another further object of the present invention to provide a wafer transfer pad cleaning process that utilizes a rotating brush which rotates at a speed of less than 500 rpm.

It is still another object of the present invention to provide a vacuum pressure system in a wafer transfer pad that does not cause breakage of the wafer when contacting the wafer due to a sudden pressure surge.

It is yet another object of the present invention to provide a vacuum pressure system for a wafer transfer pad which is adapted to apply a vacuum pressure at a rate smaller than 30 psi/sec.

It is yet another further object of the present invention to provide a vacuum pressure system for a wafer transfer pad that does not cause an impact on the wafer and subsequent breakage of the wafer upon contacting the wafer during the pick-up process.

It is still another further object of the present invention to provide an apparatus for eliminating wafer breakage during wafer transfer by a vacuum pad by incorporating a pressure regulating valve situated in a vacuum conduit for regulating a vacuum pressure applied at a rate not higher than 30 psi/sec. to the surface of the wafer transfer pad.

SUMMARY OF THE INVENTION

The method can be carried out by first providing a wafer transfer pad that is fabricated of a sintered ceramic material, i.e. such as a sintered glass, with a multiplicity of vacuum passageways therethrough, then cleaning a surface of the pad that contacts a wafer by contacting a rotating brush and a spray of water, then removing substantially all particles from the surface of the pad, contacting the surface of the pad to a surface of the wafer, applying a vacuum pressure to the surface of the pad by withdrawing air through the multiplicity of vacuum passageways, and picking-up the wafer and transferring to a different process station in the grinding apparatus.

The invention further discloses an apparatus for eliminating wafer breakage during a wafer transfer process in a grinding apparatus by utilizing a wafer transfer pad. The apparatus includes a wafer transfer pad that is fabricated of a sintered ceramic material, such as a sintered glass material, with a multiplicity of vacuum passageways therethrough, a vacuum conduit for applying a vacuum pressure on a backside of the wafer transfer pad from a vacuum source, and a pressure regulating valve situated in the vacuum conduit for regulating a vacuum pressure applied at a rate not higher than 30 psi/sec., and preferably not higher than 10 psi/sec. to the surface of the wafer transfer pad.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

Figure 1:
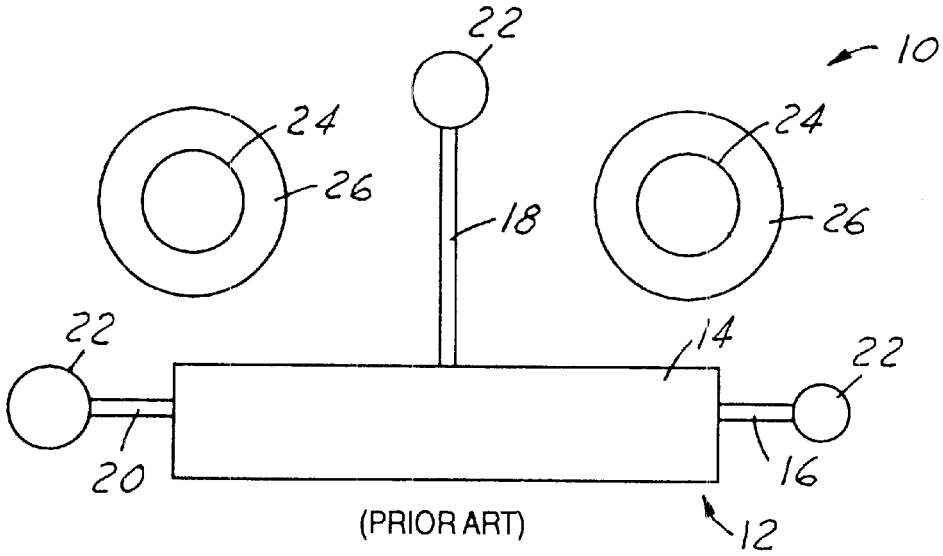
(PRIOR ART) FIG. 1
FIG. 1 is a plane view of a T-shaped wafer transfer arm equipped with three wafer transfer pads and two chuck tables loaded with wafers.
Figure 2:
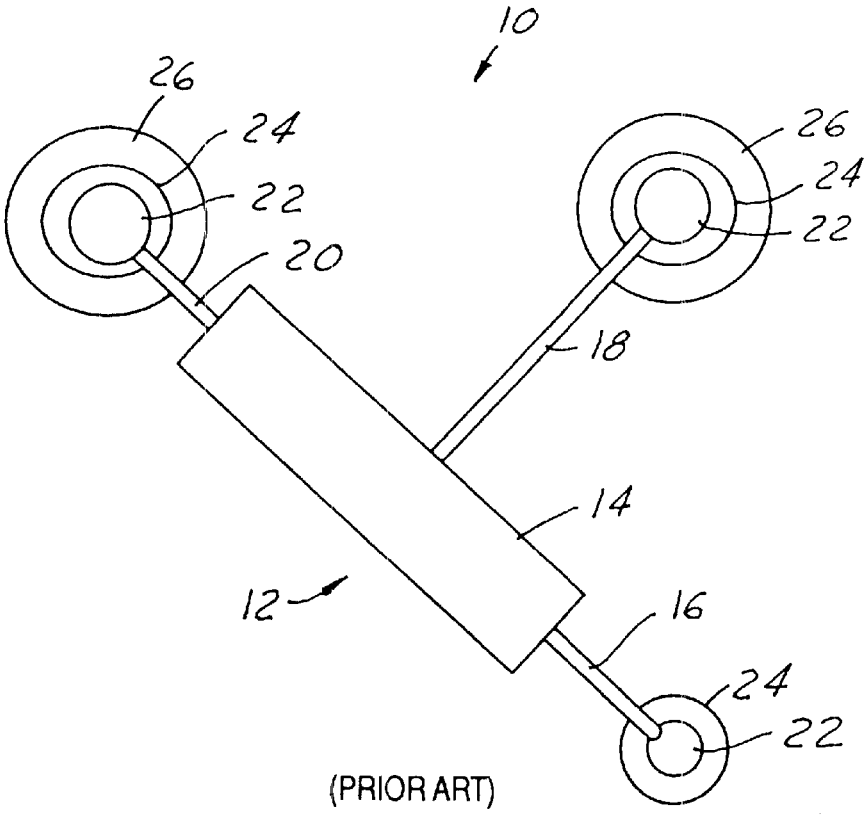
(PRIOR ART) FIG. 2
FIG. 2 is a plane view of the conventional T-shaped wafer transfer arm of FIG. 1 after the arm is turned with the wafer transfer pads situated on top of the wafers.

The present invention discloses a method for eliminating wafer breakage during a wafer transfer process in a backside grinding apparatus by a vacuum pad. The invention further discloses an apparatus for eliminating wafer breakage during a wafer transfer process in a backside grinding apparatus by using a vacuum pad incorporating a pressure regulating valve.

The method can be carried out by first providing a wafer transfer pad that is fabricated of a sintered ceramic material, i.e. such as a sintered glass, with a multiplicity of vacuum passageways therethrough, then cleaning a surface of the pad that contacts a wafer by contacting a rotating brush and a spray of water, then removing substantially all particles from the surface of the pad, contacting the surface of the pad to a surface of the wafer, applying a vacuum pressure to the surface of the pad by withdrawing air through the multiplicity of vacuum passageways, and picking-up the wafer and transferring to a different process station in the grinding apparatus.

The method may further include the step of applying the vacuum pressure to the surface of the pad at a rate not higher than 30 psi/sec., and preferably not higher than 10 psi/sec. The rotating brush may be suitably turned at a rotational speed of less than 500 rpm, and preferably at less than 300 rpm. The method may further include the step of withdrawing air through the multiplicity of vacuum passageways to a negative pressure of less than 100 psi, and preferably to a negative pressure of less than 80 psi.

Instead of utilizing a rotating brush, the present invention method may be carried out by first contacting the surface of the wafer transfer pad to a surface of the wafer, then applying a vacuum pressure at a rate of less than 30 psi/sec. to the surface of the wafer transfer pad by withdrawing air through the multiplicity of vacuum passageways for picking-up the wafer.

The invention further discloses an apparatus for eliminating wafer breakage during a wafer transfer process in a grinding apparatus by utilizing a wafer transfer pad. The apparatus includes a wafer transfer pad that is fabricated of a sintered ceramic material, such as a sintered glass material, with a multiplicity of vacuum passageways therethrough, a vacuum conduit for applying a vacuum pressure on a backside of the wafer transfer pad from a vacuum source, and a pressure regulating valve situated in the vacuum conduit for regulating a vacuum pressure applied at a rate not higher than 30 psi/sec., and preferably not higher than 10 psi/sec. to the surface of the wafer transfer pad.

The apparatus may further include a cleaning solution spray means for spraying a cleaning solution onto a front side of the wafer transfer pad for removing any polishing debris on the pad, or a brushing means for brushing the front side of the wafer transfer pad for removing any polishing debris on the pad.

The invention utilizes a novel brush design to remove substantially all residual particles on the surface of a wafer transfer pad, such that a concentrated stress point on the wafer transfer pad does not impact the wafer and cause the wafer to break. It has been found that residual particles on the vacuum pad is the main cause for wafer breakage during the vacuum pick-up process of the wafer. The wafer breakage is partially caused by the thinned wafer back that has taken place in the backside grinding apparatus. Since the wafer backside grinding process is used to remove excessive thickness in the wafer backside, in the modern fabrication technology, most IC products tend to have a thinner thickness which further challenges the grinding quality control. The uneven stress distribution on a wafer carried by a vacuum pad due to the presence of particles therein-between has been determined to be the major cause for wafer breakage. The present invention novel method and apparatus either eliminates the presence of particles completely by the brushing method, or alleviates the stress issue by applying a vacuum pressure at a substantially slow rate such that a sudden impact on the wafer is avoided.

Figure 5:
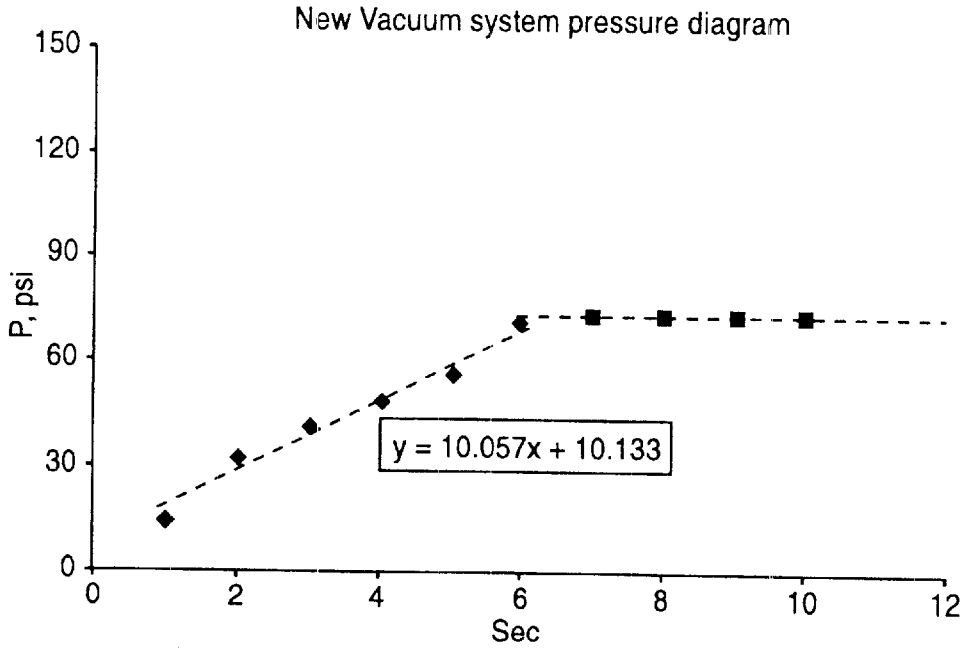
FIG. 5 is a graph illustrating a present invention vacuum system pressure diagram for the vacuum pressure applied to the wafer transfer pad.
Figure 6:
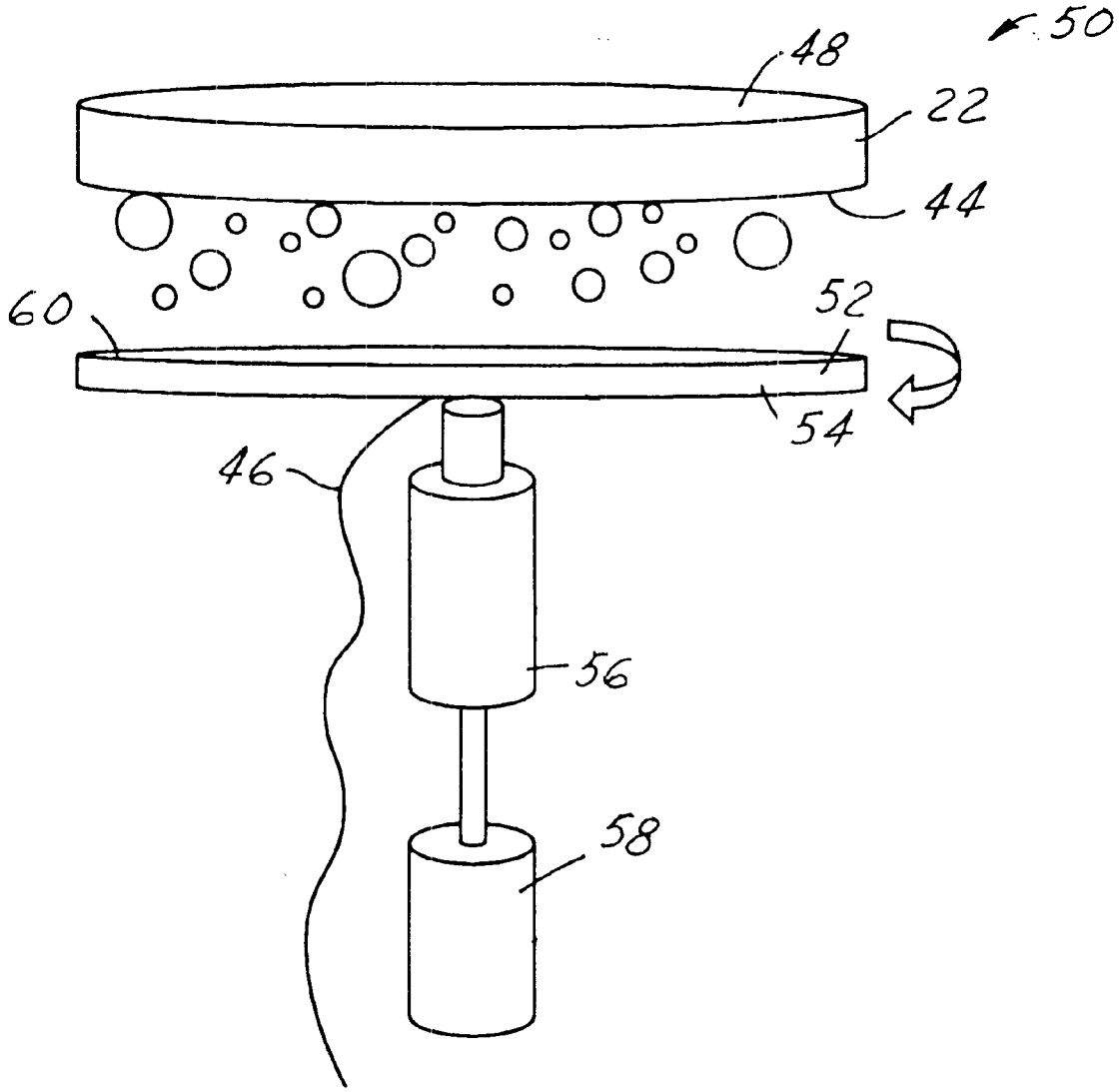
FIG. 6 is a graph illustrating a present invention wafer transfer pad cleaning system utilizing a spray solvent and a rotating brush.

Referring now to FIG. 5, wherein a present invention method for eliminating wafer breakage during wafer transfer in a polishing apparatus by a wafer transfer pad with slowly applied vacuum pressure is shown. It is seen that a vacuum pressure is applied at a rate of about 10 psi/sec., even though a rate of less than 30 psi/sec. may be adequate for the present invention novel method. By applying a vacuum pressure at a slower rate onto the wafer, a sudden impact on the wafer is avoided and thus wafer breakage caused by the impact can be eliminated. When air is withdrawn from the multiplicity of vacuum passageways (not shown), a vacuum pressure at less than 100 psi, and preferably at less than 80 psi can be reached which is suitable for use in the present invention for holding a 6" wafer Referring now to FIG. 6, wherein a present invention wafer transfer pad cleaning system 50 is shown. The wafer transfer pad cleaning system consists of a wafer transfer pad 22, a rotating brush 52 that is mounted on a backing plate 54 and rotated by motor 56. An air cylinder 58 is further utilized to raise or lower the rotating brush 52 to engage or disengage the brush from the surface of the wafer transfer pad 22. The wafer transfer pad 22 is fabricated of a sintered ceramic material, such as a sintered glass that has a multiplicity of vacuum passageways therethrough such that air may be withdrawn from a top side 48 of the pad 22. A water supply conduit 46 is further utilized to supply water onto the top surface 60 of the rotating brush 52. A suitable rotating speed for the rotating bush 52 may be less than 500 rpm, and preferably less than 300 rpm. The present invention novel wafer transfer pad cleaning apparatus incorporating the rotating brush 52 greatly improves the removal efficiency of contaminating particles on the surface 44 of the wafer transfer pad 22. The mechanical agitation supplied by the rotating brush 52 on top of the spraying water was proven a more efficient cleaning method than only using a spray water flow onto the bottom surface 44 of the pad 22.

Figure 7:
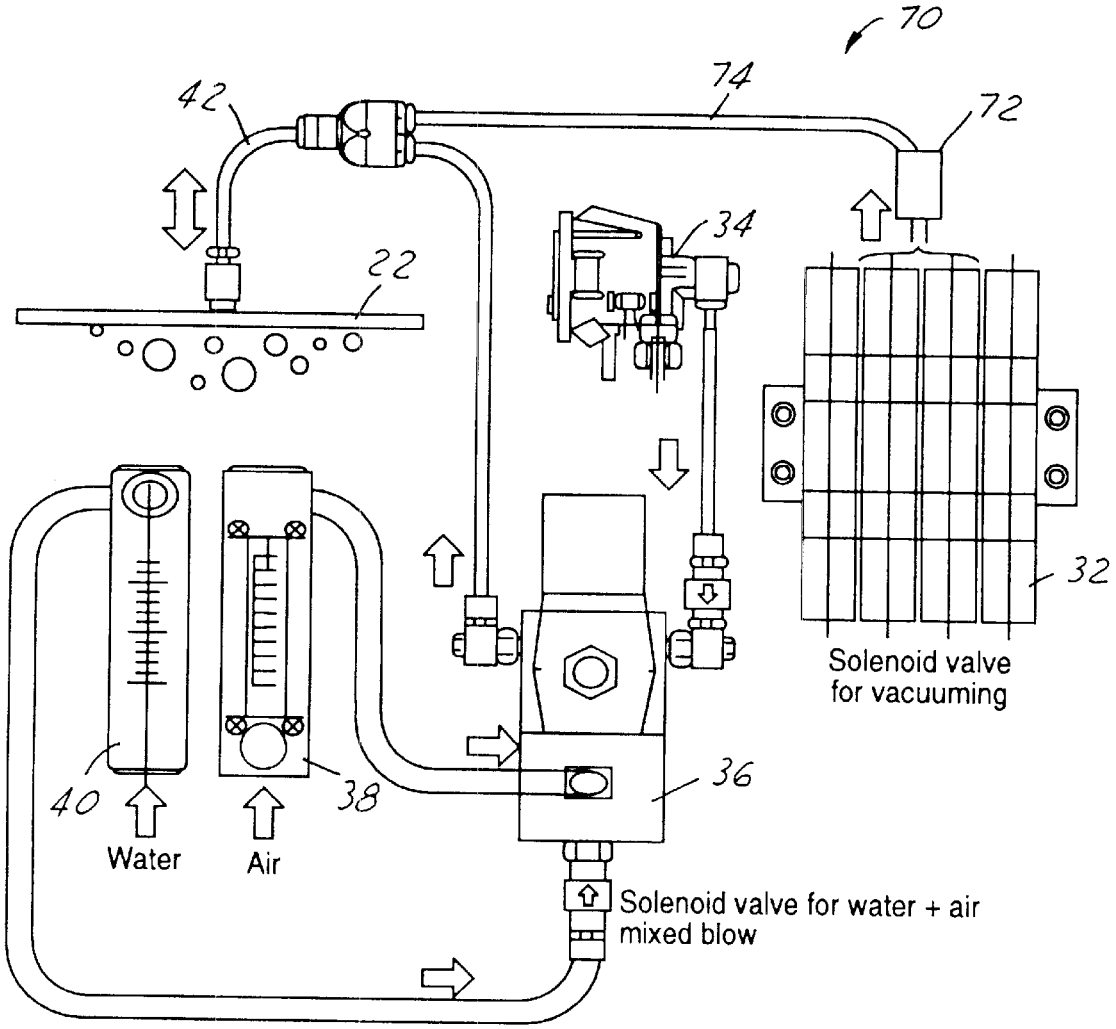
FIG. 7 is a present invention wafer transfer pad cleaning system incorporating a pressure regulating valve.

In another embodiment of the present invention novel method, instead of utilizing a rotating brush, a reduced pressure rate is applied onto the wafer surface during the vacuum pick-up stage. This is shown in FIG. 7.

Figure 3:
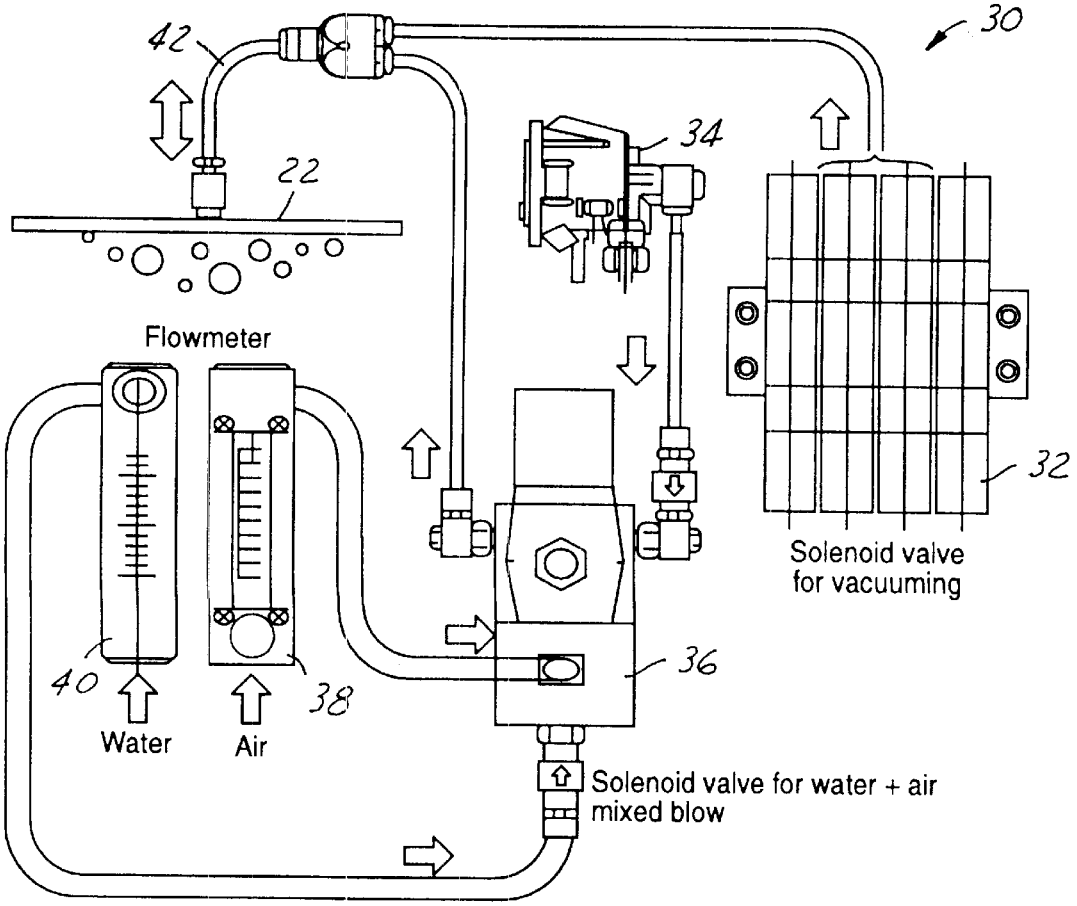
(PRIOR ART) FIG. 3
FIG. 3 is a graph illustrating a conventional wafer transfer pad cleaning system utilizing only a spray cleaning solvent.
Figure 4:
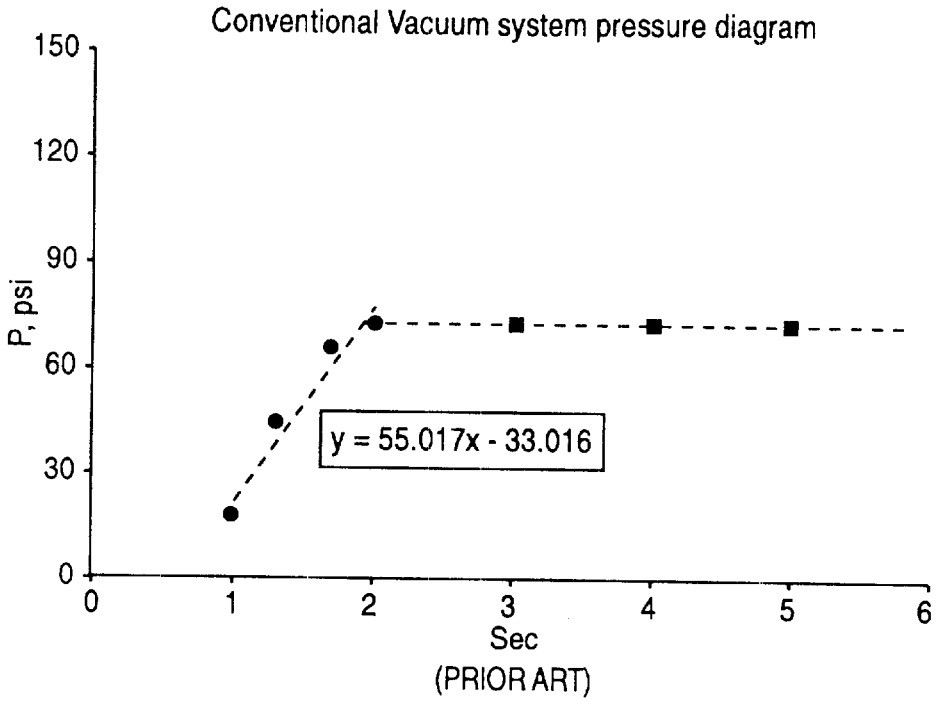
FIG. 4 is a graph illustrating a conventional vacuum system pressure diagram for the vacuum pressure applied to the wafer transfer pad.

When compared to the conventional pad cleaning system shown in FIG. 3, the present invention vacuum pad cleaning system 70 includes a pressure regulating valve 72 that is mounted in conduit 74 that regulates a vacuum pressure produced from a vacuum source (not shown) through a solenoid valve 32. The pressure regulating valve 72 is effective in reducing a vacuum pressure, as shown in FIG. 5, or a vacuum pressure rate at less than 30 psi/sec., or preferably at less than 10 psi/sec. from the conventional 60 psi/sec. The reduction of the vacuum pressure ramp-up rate significantly reduces the chances of wafer breakage caused by a sudden impact due to the pressure increase in the conventional method. A total pressure acted on by the vacuum pad through the multiplicity of vacuum passageways in the pad can be less than 100 psi, and preferably at less than 80 psi.

The present invention novel method and apparatus for eliminating wafer breakage during wafer transfer in a grinding apparatus by a wafer transfer pad (or a vacuum pad) by utilizing either an improved cleaning method of rotating brush or a reduced pressure application rate to avoid sudden impact on the wafer have therefore been amply described in the above description and in the appended drawings of FIGS. 1~7.

While the present invention has been described in an illustrative manner, it should be understood that the terminology used is intended to be in a nature of words of description rather than of limitation.

Furthermore, while the present invention has been described in terms of a preferred and an alternate embodiment, it is to be appreciated that those skilled in the art will readily apply these teachings to other possible variations of the inventions.

The embodiment of the invention in which an exclusive property or privilege is claimed are defined as follows:

What is claimed is:

1. An apparatus for eliminating wafer breakage during wafer transfer by a vacuum pad comprising:

a wafer transfer pad fabricated of a sintered ceramic material with a multiplicity of vacuum passageways therein;

a vacuum conduit for applying a vacuum pressure on a backside of said wafer transfer pad from a vacuum source; and a pressure regulating valve situated in said vacuum conduit for regulating a vacuum pressure applied at a rate not higher than 30 psi/sec. to said surface of the wafer transfer pad.

2. An apparatus for eliminating wafer breakage during wafer transfer by a vacuum pad according to claim 1, wherein said pressure regulating valve regulates a vacuum pressure applied at a rate not higher than 10 psi/sec.

3. An apparatus for eliminating wafer breakage during wafer transfer by a vacuum pad according to claim 1 further comprising a cleaning solution spray means for spraying a cleaning solution onto a front side of said wafer transfer pad for removing any polishing debris on said pad.

4. An apparatus for eliminating wafer breakage during wafer transfer by a vacuum pad according to claim 1 further comprising a water spray means for spraying water onto a front side of said wafer transfer pad for removing any polishing debris on said pad.

5. An apparatus for eliminating wafer breakage during wafer transfer by a vacuum pad according to claim 1, wherein said pressure regulating valve being capable of regulating a vacuum pressure applied at a rate between about 10 psi/sec. and about 60 psi/sec.

6. An apparatus for eliminating wafer breakage during wafer transfer by a vacuum pad according to claim 1 further comprising a brushing means for brushing said front side of the wafer transfer pad for removing any polishing debris on said pad.

7. An apparatus for eliminating wafer breakage during wafer transfer by a vacuum pad according to claim 1 further comprising a rotating brush means for brushing said front side of the wafer transfer pad for removing any polishing debris on said pad.

8. An apparatus for eliminating wafer breakage during wafer transfer by a vacuum pad according to claim 1 further comprising a rotating brushing means capable of rotating at a speed of less than 500 rpm for removing any polishing debris on said pad.

* * * * *